United States Patent [19]

Close

[11] Patent Number: 5,058,846

[45] Date of Patent: Oct. 22, 1991

[54] PULL DOWN DISPLAY AND STORAGE APPARATUS

[75] Inventor: James G. Close, Malikoff, Tex.

[73] Assignee: Hoyt-Close Products, Inc., Lafayette, La.

[21] Appl. No.: 485,153

[22] Filed: Feb. 23, 1990

[51] Int. Cl.[5] ..... E04G 3/00

[52] U.S. Cl. ..... 248/292.1; 248/585; 312/247; 312/325; 211/104; 211/201

[58] Field of Search ..... 248/284, 292.1, 293, 248/585; 312/247, 266, 325; 211/104, 118, 201

[56] References Cited

U.S. PATENT DOCUMENTS

| | | | |
|---|---|---|---|
| 264,748 | 9/1882 | Potts | 312/266 X |
| 2,634,188 | 4/1953 | Davis | 312/247 |
| 2,822,229 | 2/1958 | Carlson | 248/284 |
| 2,938,631 | 5/1960 | Brey | 248/284 |
| 3,172,632 | 3/1965 | Borg | 248/284 |
| 3,417,953 | 12/1968 | Hillquist et al. | 248/284 |
| 3,490,727 | 1/1970 | Miller | 248/284 |
| 3,586,324 | 6/1971 | Bearson | 248/284 X |
| 3,667,714 | 6/1972 | Ziaylek, Jr. | 248/284 |
| 4,076,351 | 2/1978 | Wyant | 312/247 |
| 4,330,101 | 5/1982 | Andersen | 248/284 |

FOREIGN PATENT DOCUMENTS

| | | | |
|---|---|---|---|
| 576890 | 6/1976 | Switzerland | 248/284 |

*Primary Examiner*—Gary L. Smith
*Assistant Examiner*—Michael J. Milano
*Attorney, Agent, or Firm*—Pravel, Gambrell, Hewitt, Kimball & Krieger

[57] ABSTRACT

The invention is a movable frame for connection to and movement with respect to a fixed support, said movable frame may be comprised of multiple elements including a movable frame member, a pivot means, a spring means, a dampening means, and a support means. The combination of the movable frame, the pivot means and a fixed support form the preferred invention embodiment of a pull down display and storage apparatus. The invention also includes a method for moving products from an initial raised position to a final lower position by the step of pulling down on a movable frame, when the movable frame is comprised of the elements discussed herein.

4 Claims, 2 Drawing Sheets

PULL DOWN DISPLAY AND STORAGE APPARATUS

BACKGROUND OF THE INVENTION

This invention relates to the field of display and storage apparatus. In particular, it is an apparatus and method for displaying and storing items at an elevated height which can be pulled down to a convenient height to remove the items from the apparatus.

New products for the consumer and competing brands of the same product are constantly being developed. One of the chief problems facing retail stores is finding the shelf space to display these items for sale to customers. For example, grocery store space is allocated to competing vendors and producers. Vendors are constantly fighting for more shelf space. This shortage of shelf space makes it difficult to display new products and forces vendors to cannibalize a portion of their allocated space simply to display new products. Because of their small size, convenience stores face this problem to a greater degree than grocery stores.

In most retail stores, all available floor and display space has been utilized to the fullest extent. Items are displayed as high as an average customer can reach. This usually means products are displayed from the floor to a height of about six feet above the floor. Products displayed at a greater height are impossible to reach. In modern "warehouse stores," items are displayed to a height of about seven feet and cannot be reached by short customers. The space above seven feet is used to store similar items in stacks.

If it can be shoehorned into an existing store, additional display space costs the retailer an insignificant amount of money. Overhead in terms of rent, utilities and labor remains practically the same, but the number and type of items that can be displayed and sold increases, increasing sales per square foot of store. A retailer can save significant amounts of energy and money in a smaller store with the same display and shelving footage as a larger store. One solution which may offer additional display space is a set of shelves hanging from a ceiling, such as that disclosed in U.S. Pat. No. 4,295,432.

SUMMARY OF THE INVENTION

The invention is a movable frame for connection to and movement with respect to a fixed support. The movable frame may be comprised of multiple elements including a movable frame member, a pivot means, a spring means, a dampening means, and a support means. The combination of the movable frame, the pivot means and a fixed support form the preferred invention embodiment of a pull down display and storage apparatus.

The pivot means is interconnected between the movable frame member and the fixed support for combined pivoting movement of the frame member from a first position adjacent the fixed support to a second position outwardly from and downwardly with respect to the fixed support. The preferred pivot means comprises upper and lower pivot arms which are pivotally coupled to the fixed support and the movable frame member. The upper and lower pivot arms support the movable frame member and permit the movable frame to swing vertically downward from a first retracted position adjacent the fixed support to an extended position below the fixed support and to return to said retracted position.

The optional spring means is interconnected between the movable frame member and the fixed support. The spring means biases the movable frame in a retracted position by pulling the movable frame member toward the fixed support as the movable frame member moves outwardly and downwardly from the fixed support.

The invention also includes a method for moving products from an initial raised position to a final lower position by the step of pulling down on a movable frame, when the movable frame is comprised of the elements discussed herein.

DETAILED DESCRIPTION

Figure 1:
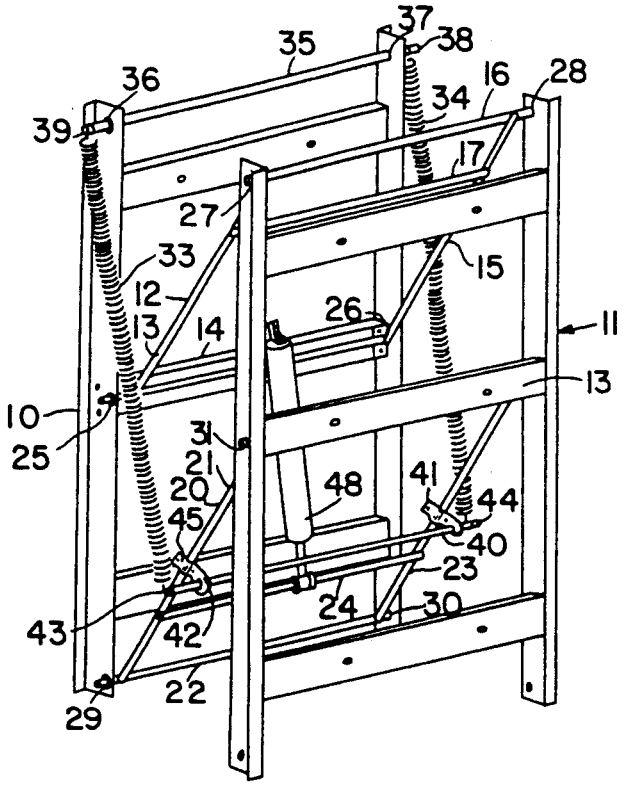
FIG. 1 is an isometric drawing of the pull down display and storage apparatus.

A shelf at eye level is the best display space in any store. It catches a shopper's attention and is easy to reach. Unfortunately, a retail store has too little eye level space. In most stores, the only space available is above six feet and out of reach for all but the tallest of shoppers. The preferred pull down display and storage apparatus of the present invention allows the space above six feet to be utilized in a retail environment for the display and sale of products in an attractive fashion. With the instant invention, it is a simple matter for even a five foot tall shopper to pull the unit down to her chest and eye level, remove a product, and start the unit on its upward course to its retracted position. With just a start by the customer, the preferred unit automatically returns to its original raised position.

Although the pull down apparatus may be dimensioned to most any size, the preferred apparatus is sized to about 47 and 35 inches overall width to allow for easy of installation in conjunction with the modular 48 and 36 inch shelving and gondolas common to the retail industry. A height of about 30 to 36 inches overall is also preferred. These overall dimensions of a display support means can be easily mounted on a movable frame about 10 to 20 inches or more in width. Of course, smaller or greater dimensions are also useful.

Placing rows of the pull down display and storage apparatus above existing wall shelving, gondolas and refrigerated displays may add twenty percent or more display space to a retail store. For example, a small grocery store with ten gondolas 50 feet long, 400 feet of refrigerated display, and 200 feet of wall shelving could add 4000 usable square feet of display face with peg board on the pull down apparatus. Above 100 feet of refrigerated display, 250 square feet of space (enough to accommodate 1000 individually displayed videotapes) could be added. Above 1000 feet of gondolas, 5000 square feet of peg board items could be displayed.

Of course, display fronts can be varied to accommodate varying merchandise. Possibilities include peg board, shelves, cups, troughs, or other displays.

In addition to the obvious retail store applications, the pull down apparatus is desirable for numerous storage uses. It is ideal for storing odds and ends in the typically cluttered home garage, or for storing spices, cooking needs, and glasses in restaurants and home kitchens. Small items can be easily stored within reach of workers in factories. The list goes on and on.

The movable frame invention which is the core of the pull down display and storage apparatus is comprised of several elements. The movable frame interacts with a fixed support by connection of a movable frame member to and movement of that member relative to the fixed support by a pivot means. The pivot means provides for movement of the movable frame from a first retracted position adjacent the fixed support to and past a second position and to a third position near the fixed support during continued downward movement. The movable frame may also be comprised of other elements including a spring means, a dampening means, and a support means for supporting and displaying products on the movable frame.

As used herein, the terms "movable frame" and "pull down display and storage apparatus" are not synonymous. But it should be recognized that statements about the "movable frame" also describe and apply to the "pull down apparatus." Likewise, statements about the pull down apparatus also describe and apply to the movable frame. The only exceptions are the uses to which the movable frame may be placed and the fact that the pull down apparatus may or may not include a fixed support.

The fixed support is a stationary support. It may be part of or be mounted to a wall, ceiling, floor, or shelving unit. The movable frame upon which products are displayed and stored is supported by the fixed support preferably through upper and lower pivot arms. The fixed support for the pull down apparatus in a retail setting may be attached to standard height extensions commonly available to increase the height of modular gondolas and shelving units.

The upper pivot arm has two ends, one end pivotally coupled to the fixed support relatively near a middle of the fixed support and the other end pivotally coupled to the movable frame member relatively near a top of the movable frame member. The lower pivot arm has two ends, one end pivotally coupled to the fixed support relatively near a bottom of the fixed support and the other end pivotally coupled to the movable frame member relatively near a middle of the movable frame member. The pivot arms support the movable frame member and permit it to swing vertically downward from a first retracted position adjacent the fixed support to an extended position below the fixed support and to return to the retracted position.

A spring means interconnected between the movable frame member and the fixed support biases the movable frame member in the first retracted position. The spring means initially pulls the movable frame member toward the fixed support as the member moves outwardly from the fixed support and pulls the member upwardly as the member moves downwardly with respect to the fixed support. Depending on the particular design of the movable frame apparatus, the spring means may also pull the movable frame member toward the fixed support as the member approaches the limit of its downward travel below the fixed support.

The spring means has two ends, preferably one end attached to the fixed support and the other end attached to the movable frame member, or most preferably, the lower pivot arm. In some designs, attachment could be made to the upper pivot arm. The attachment to the fixed support should be at a point vertically higher than the spring means attachment point to the movable frame or pivot means when the movable frame rests in the retracted position.

Preferably, the spring means is attached relatively near a top of the fixed support. More preferably, the spring means is attached to a horizontal rod mounted to the fixed support relatively near a top thereof.

A screw means to change the tension of the spring means is also desirable. This would permit the use of different product loads on the movable frame without physically changing the spring means. One would merely turn a screw to stretch or loosen the spring means and change the force that the spring means exerts against the load on the movable frame.

The spring means tension may also be changed by substituting a new spring means or adding additional spring means to the apparatus. Although two springs, one on each side of the apparatus, provide the preferred spring means, additional springs on each side can be added to increase the tension of the spring means.

It may be desirable to adjust the spring tension so that a maximum pull down pressure of ten pounds is required at the maximum point. This would allow for a product load of one pound, five pounds or up to ten pounds on the movable frame member without any adjustment required. In this example, the product load could vary by as much as ten pounds of products.

This ten pound load example is an extreme since the apparatus will often be used for blister packs or other light products. But it should be noted that the apparatus is not simply a load pulling down on a spring, such as the system used in single or double sash windows, which require an exact balance of weight and spring tension.

In a preferred embodiment, the spring means is attached to an offset pivot arm extension, which is itself attached to the lower pivot arm. This offset extension of the pivot arm is located between the lower pivot arm and movable frame member when the movable frame member is in the retracted position, and when the movable frame member is in its extended position, the lower pivot arm is located between the offset extension and the movable frame member. Please see FIGS. 3 and 4. The offset pivot arm extension is preferably a rod extending to each side of the lower pivot arm.

The purpose of the offset extension is to lock the movable frame member in the extended position automatically. In all positions of the movable frame except the fully extended position, the spring means will pull on the lower pivot arm and the movable frame member urging the movable frame member into its upward retracted position. But because of the offset attachment of the spring means to the lower pivot arm, there will be a vertical alignment position near the extended position where the point of attachment of the spring means to the offset extension is directly below and aligned with the pivotally coupling point attaching the lower pivot arm to the fixed support and the upper point of attachment of the spring means to the fixed support.

Urging the movable frame member past this vertical alignment position to its fully extended position will cause the point of attachment of the spring means to the offset extension to move past this vertical alignment with the lower pivot arm and spring means attachment point to the fixed support so that the pull of the spring means will urge the movable frame member in a downward extended position. To return the movable frame member to its upward retracted position, all that is required is to move the movable frame member a short distance in its downward position away from the fixed support to move the offset extension point of attachment past the vertical alignment position to a position between the movable frame member and the point of attachment of the lower pivot arm to the fixed support. Once the vertical alignment position has been passed, the spring means will automatically return the movable frame member to its upward retracted position.

The most preferred offset pivot arm extension is a rod attached to the lower pivot arm by brackets which maintain the offset rod a set distance away from the lower pivot arm. Preferably, the position of the brackets may be varied along the length of the lower pivot arm. The movement of the offset rod along the pivot arm provides a way to adjust the tension of the spring means. Of course, other offset extensions may be attached to the pivot arm instead of a rod.

Most preferably, the spring means are two springs attached to the ends of the offset rod. A plastic coating or tubing may be used to encase the ends of the offset rod to anchor the springs in place (the springs will dig into the coating) and to silence the noise of the springs rubbing on the offset rod.

The spring means may also be a mechanism which performs similarly such as elastic cords, or a mechanism which will perform the desired biasing function. Possibilities are a motor drive with a slipping clutch and a fluid cylinder with a pump.

The spring means can also be attached to the movable frame member instead of the lower pivot arm or offset extension of the lower pivot arm. But such a design will lack the automatic locking feature explained above for the fully extended position of the movable frame member. To overcome this problem, a mechanical catch can be added to the apparatus to lock the movable frame member in an extended position. The most preferred location for a catch release is in a handle employed by a customer or user to pull the movable frame down. In a variation, the spring means can also be attached to an offset extension of the movable frame member, which if long enough and positioned properly, would provide the automatic locking feature provided by the embodiment using the offset pivot arm extension.

Although the fixed support, movable frame member and pivot means may be built in various shapes, they are preferably rectangular. They may be constructed of angle iron, sheet metal, expanded metal, mesh, plastic, or any other material or combination of materials deemed appropriate.

The upper and lower pivot arms may assume various shapes. The preferred pivot arms are rectangular and comprised of rods. One of the rods from each pivot arm is pivotally coupled with the fixed support, and another of said rods from each pivot arm is pivotally coupled with the movable frame member.

It is desirable for a dampening means to be interconnected between the movable frame and the fixed support for dampening the motion of the movable frame in either an upward or downward direction, especially the upward direction of the movable frame from the second position to the first position. In the most preferred embodiment, a spring means aids in dampening motion of the number in a downward direction.

The dampening means may be attached to the movable frame member or a portion of the pivot means such as the lower pivot arm. The means may be hydraulic, pneumatic or spring. A common air cylinder door closer serves well. One design of door closer offers little resistance in the opening direction by opening a flapper valve to the air chamber allowing air to easily escape. But the closing direction is cushioned by air in the air chamber and a closed flapper valve.

In addition to varying the tension of the spring means or changing the spring means, a counterweight system may also be employed with the movable frame to offset at least a portion of the weight of things placed on the movable frame member. The counterweight system of the invention comprises a pulley mounted to the fixed support relatively near a top of the fixed support, a counterweight, and a cord passing over the pulley having two ends. One end of the cord is preferably attached to the upper pivot arm relatively near the movable frame member or the movable frame member itself, and the other end is attached to the counterweight. The counterweight is located below the pulley such that the counterweight pulls on the upper pivot arm and movable frame member through the cord to help bias the movable frame member in its retracted position.

Other variations of the movable frame invention aid in hiding the operating parts of the movable frame and provide convenient and highly visible advertising signage. One embodiment involves using a retractable device similar to a window shade between tho top of the fixed support and the top of the movable frame member. A pop-up sign on top of the movable frame member is a second variation.

The retractable device may be comprised of a cylinder mounted to a fixed support relatively near a top of the fixed support, and a flexible screen having two ends. One end of the screen is attached to the cylinder and the opposite end is attached to the movable frame member relatively near a top of the movable frame. The screen is retracted around the cylinder when the movable frame member is in its retracted position, and the screen is stretched between the fixed support and the movable frame member when the movable frame member is in its extended position.

The pop-up sign embodiment is comprised of a pop-up sign pivotally coupled to the movable frame member relatively near a top of the movable frame member, and a means for pivoting the pop-up sign between retracted and extended positions. The pop-up sign remains in a retracted position between the movable frame member and the fixed support when the movable frame member is in its retracted position, and pivots to an extended position above the movable frame member when the movable frame member has moved outwardly and downwardly from its retracted position.

The movable frame may also comprise a support means attached to the movable frame member for supporting objects placed on the support means. The support means may be a peg board, shelves, cups, troughs, or other suitable means mounted on the movable frame member to display products thereon. The support means may be a facing mounted parallel or perpendicular to the fixed support and movable frame member. Shelves may be attached to be loaded with products from the side or the front.

A handle means is preferably attached to the movable frame relatively near a bottom thereof to aid in moving the movable frame down to its extended position and back to its retracted position. The handle means is particularly important in a retail store to provide a convenient and obvious manner of using the pull down apparatus. It may also be desirable to hang a length of cord from a handle means to aid disabled persons and wheelchair customers in using the pull down apparatus.

The instant invention also includes a method for moving products from an initial raised position to a final lower position, the method comprising the step of pulling down on a movable frame as described herein. Preferably, the method step includes pulling down and out on the movable frame until the movable frame reaches its extended downward position.

Reference to FIGS. 1–5 will help illustrate the invention of the movable frame and pull down apparatus. The fixed support is indicated generally at 10 and the movable frame member at 11. Upper pivot arm 12 is comprised of rods 13, 14, 15, 16, and 17. Lower pivot arm 20 is comprised of rods 21, 22, 23, 24 and an unseen rod hidden behind horizontal slat 13 of the movable frame member 11.

Rod 14 of the upper pivot arm 12 is attached to the fixed support 10 at bushings 25 and 26 which serve as pivotal couplings. Rod 16 of the upper pivot arm 12 is attached to the movable frame member 11 at bushings 27 and 28 which serve as pivotal couplings.

Rod 22 of the lower pivot arm 20 is attached to the fixed support 10 at bushings 29 and 30 which serve as pivotal couplings. The lower pivot arm 20 is attached to the movable frame member 11 at bushing 31 and an unseen bushing hidden behind horizontal slat 13 of the movable frame member 11.

Depending upon the method of constructing the apparatus, it may be desirable to ensure rods 14, 16, 22 and 35 do not slip out of their bushings in the fixed support 10 and movable frame member 11. One possible solution is to place collars, washers, nuts, or similar means on the rods at a strategic place to stop the rods from moving relative to their bushings. Another solution is to place drive on cap nuts at the ends of rods.

Horizontal rod 35 is attached to the fixed support 10 at points 36 and 37. Springs 33 and 34 are attached to horizontal rod 35 at points 38 and 39. The other ends of springs 33 and 34 are attached to rod 40, the offset pivot arm extension, at points 43 and 44. Offset rod 40 is attached to the lower pivot arm 20 with brackets 41 and 42, attached to rods 23 and 21, respectively. Air cylinder dampening means 48 is attached to the fixed support 10 and rod 24 of the lower pivot arm 20. Part of the movable frame member 11 itself, such as slat 13, may provide the support means for supporting products thereon. Alternatively, an additional facing such as peg board may be hung on the movable frame member 11. A sign member 70 is movably secured about the bushing 27 and 28 and a bar 72 contacts and extends between the rods 13 and 15 so that, as shown in FIG. 5, as the frame member 11 moves out and down, the sign member 70 becomes erect.

Figure 2:
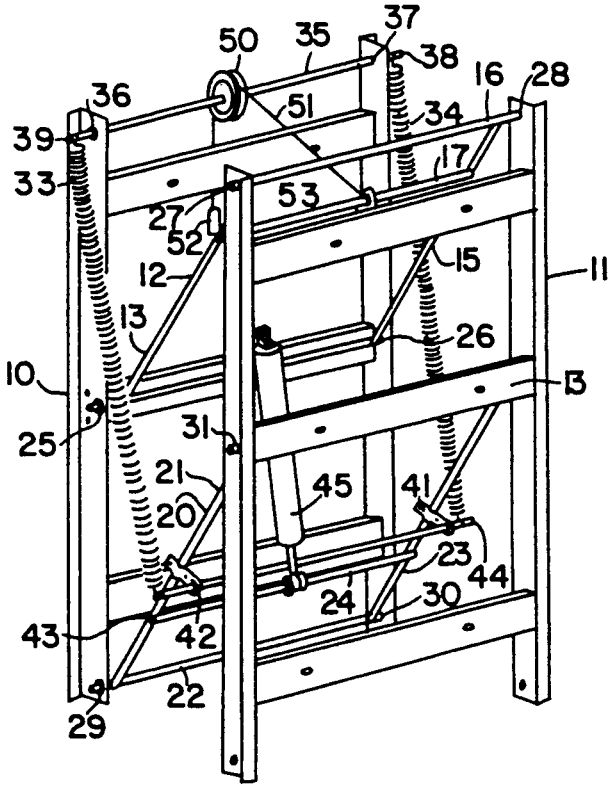
FIG. 2 is an isometric drawing of the pull down display and storage apparatus having a counterweight system to handle heavier loads.

FIG. 2 illustrates the counterweight embodiment added to the apparatus of FIG. 1 to help in handling heavier product loads on the movable frame member 11. Pulley 50 is rotatably mounted on horizontal rod 35. Cord 51 passes over the pulley 50 with one end attached to rod 17 of the upper pivot arm 12 at point of attachment 53. The other end of the cord 51 is attached to counterweight 52 hanging below pulley 50.

Figure 3:
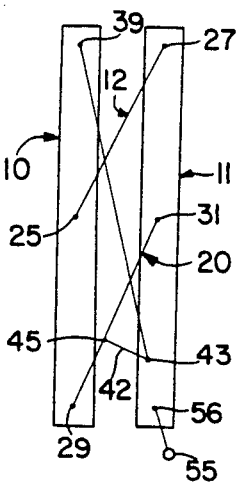
FIG. 3 is a simplified block diagram of the preferred apparatus in a retracted position.
Figure 4:
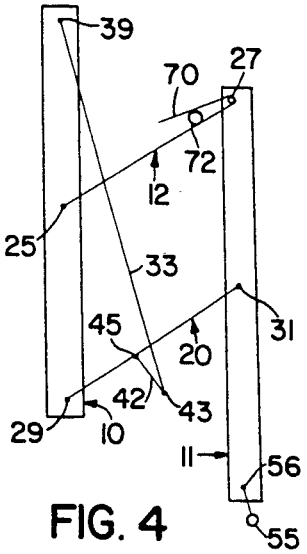
FIG. 4 is a simplified block diagram of the preferred apparatus in a partially extended position.
Figure 5:
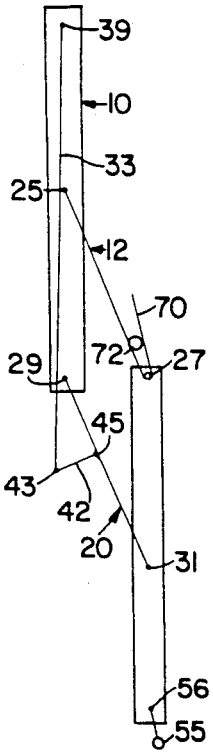
FIG. 5 is a simplified block diagram of the preferred apparatus in a fully extended position.

FIGS. 3, 4, and 5 illustrate the automatic locking feature provided by the offset pivot arm extension. FIG. 3 shows the movable frame member 11 in a retracted position adjacent the fixed support 10. In FIG. 4, there has been a downward pull on handle 55 attached to movable frame member 11 at point of attachment 56. If the handle 55 is released in this moveable frame position, the spring tension should be sufficient to overcome the pull of gravity and return the movable frame member 11 to its retracted position adjacent the fixed support 10. Note that the point of attachment 43 of the spring 33 to the offset pivot arm extension, shown here as bracket 42 attached to lower pivot arm 20 at point 45, lies between point of attachment 29 and the movable frame member 11.

FIG. 5 illustrates the fully extended, automatically locked position of movable frame member 11 below the fixed support. 10. In this position, the lower pivot arm 20 is located between point of attachment 43 to the offset pivot arm extension and the movable frame member 11. Although spring 33 is stretched to its highest tension level, spring 33 is powerless to raise the movable frame member 11. Instead, spring 33 urges the movable frame member in a downward direction closer to the fixed support 10 since the point of attachment 43 has passed the vertical alignment position formed by points 29, 25 and 39.

It may be desirable to place a stop means on the apparatus to interact between the fixed support 10 or movable frame member 11 and a pivot arm 12 or 20 to stop the downward travel of the movable frame member 11 at a desired position. The stop should be positioned to prevent the movable frame member 11 from banging into objects below the apparatus.

Movable frame member 11 will remain in this fully extended position until handle 55 is pulled outward, moving attachment point 43 past the vertical alignment position. Once point 43 passes the vertical alignment position, the spring 33 will automatically pull movable frame member 11 back up to its retracted position adjacent the fixed support 10.

Figure 6:
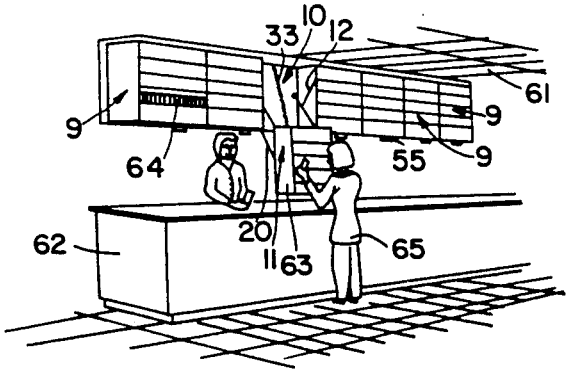
FIG. 6 is a perspective drawing of multiple apparatus hanging from the ceiling above a retail sales counter.

FIG. 6 illustrates multiple pull down and display apparatus 9 hanging from a ceiling 61 above a retail sales counter 62. The seven apparatus 9 displaying video tapes 64 are comprised of movable frame members 11 hanging from a fixed support 10 by upper pivot arms 12 and lower pivot arms 20. Spring 33 is visible above the movable frame member 11. Support means 63 is attached to the movable frame member 11 for supporting the video tapes 64. The shopper 65 used a handle such as 55 to pull the movable frame member 11 and support means 63 down to reach a video tape 64.

Figure 7:
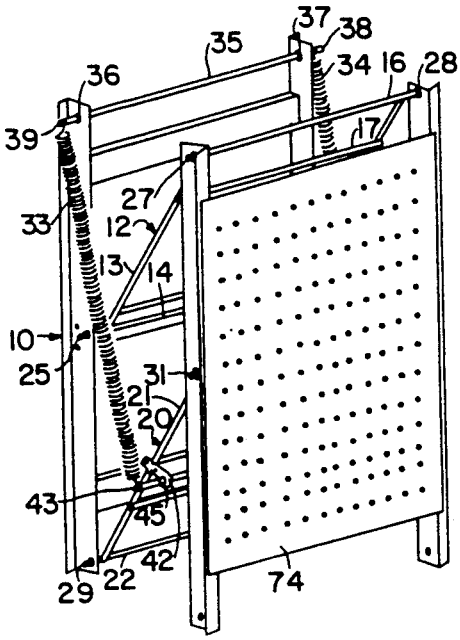
FIG. 7 is an isometric drawings of a pull down display according to the present invention.
Figure 8:
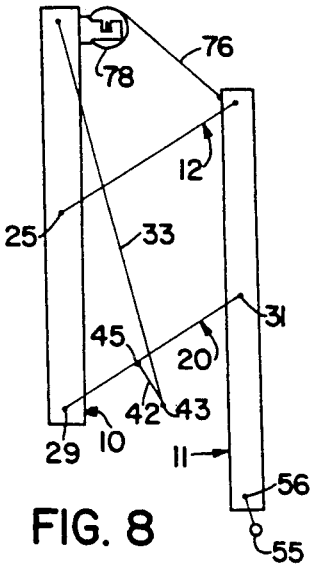
FIG. 8 is a side schematic view of a pull down display according to the present invention.
Figure 9:
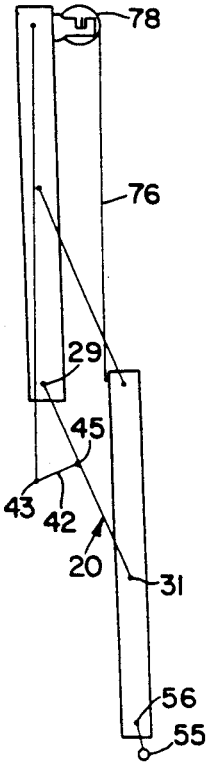
FIG. 9 is a side schematic view of the pull down display of FIG. 8.

FIG. 7 shows a peg board 74 affixed to the frame member 11 of the device shown in FIG. 1, FIGS. 8 and 9 show a retractable flexible screen 76 attached to a retracting cylinder 78 at one end and to the movable frame 11 at the other end. As shown in FIG. 9, the screen has been pulled from the cylinder 78 upon outward/downward movement of the frame member 11.

Many other variations and modifications may be made in the concepts described above by those skilled in the art without departing from the concepts of the present invention. Accordingly, it should be clearly understood that the concepts disclosed in the description are illustrative only and are not intended as limitations on the scope of the invention.

What is claimed is:

1. A movable frame for connection to and movement with respect to a fixed support, the movable frame comprising a movable frame member, pivot means interconnected between the movable frame member and the fixed support for combined pivoting movement of the frame member from a first position adjacent the fixed support to a second position outwardly from and downwardly with respect to the fixed support, the pivot means comprising an upper pivot arm having two ends, one end pivotally coupled to the fixed support relatively near a middle of the fixed support and the other end pivotally coupled to the movable frame relatively near a top of the movable frame member, a lower pivot arm having two ends, one end pivotally coupled to the fixed support relatively near a bottom of the fixed support and the other end pivotally coupled to the movable frame member relatively near a middle of the movable frame member, said upper and lower pivot arms supporting the movable frame member and permitting the movable frame member to swing vertically downward from a first retracted position adjacent the fixed support to an extended position below the fixed support and to return to said retracted position, a retractable device comprising a cylinder mounted to the fixed support relatively near a top of the fixed support, and a flexible screen having two ends, one end attached to the cylinder and the opposite end attached to the movable frame member relatively near a top of the movable frame, said screen retracted around the cylinder when the movable frame member is in said retracted position, and said screen stretched between the fixed support and the movable frame member when the movable frame member is in said extended position.

2. A movable frame for connection to and movement with respect to a fixed support, the movable frame comprising a movable frame member, pivot means interconnected between the movable frame member and the fixed support for combined pivoting movement of the frame member from a first position adjacent the fixed support to a second position outwardly from and downwardly with respect to the fixed support, a pop-up sign pivotally coupled to the movable frame member relatively near a top of the movable frame member, means for pivoting the pop-up sign between retracted and extended positions, and said pop-up sign being in a retracted position between the movable frame member and the fixed support when the movable frame member is in its retracted position, and said pop-up sign pivoting to an extended position above the movable frame member when the movable frame member has moved outwardly and downwardly from its retracted position.

3. A movable frame for connection to and movement with respect to a fixed support, the movable frame comprising a movable frame member, an upper pivot arm comprised of rods, one rod pivotally coupled to the fixed support relatively near a middle of the fixed support and another of said rods pivotally coupled to the movable frame member relatively near the top of the movable frame member, a lower pivot arm comprised of rods, one rod pivotally coupled to the fixed support relatively near a bottom of the fixed support and another of said rods pivotally coupled to the movable frame member relatively near the middle of the movable frame member, said upper and lower pivot arms supporting the movable frame member and permitting the movable frame member to swing vertically downward from a first retracted position adjacent the fixed support to an extended position below the fixed support and to return to said retracted position, an offset pivot arm extension comprised of a rod extending to each side of the lower pivot arm, said offset pivot arm extension attached to the lower pivot arm and located between the lower pivot arm and the movable frame member when the movable frame member is in said retracted position, and said lower pivot arm located between said offset pivot arm extension and the movable frame member when the movable frame member is in said extended position, a horizontal rod mounted to the fixed support relatively near a top thereof, two springs, one end of each spring attached to said horizontal rod and the other end of each spring attached to the offset pivot arm extension rod, a support means attached to the movable frame member for supporting objects placed on the support means, a retractable device, said device comprising a cylinder mounted to the fixed support relatively near a top of the fixed support, and a flexible screen having two ends, one end attached to the cylinder and the opposite end attached to the movable frame member relatively near the top of the movable frame, said screen retracted around the cylinder when the movable frame member is in said retracted position, said screen stretched between the fixed support and the movable frame member when the movable frame member is in said extended position, and dampening means interconnected between the movable frame member and the fixed support for dampening the motion of the movable frame member.

4. A pull down display and storage apparatus, comprising:

a fixed support, a movable frame comprising a movable frame member and pivot means interconnected between the movable frame member and the fixed support for combined pivoting movement of the frame member from a first position adjacent the fixed support to a second position outwardly from and downwardly with respect to the fixed support, the pivot means comprising an upper pivot arm having two ends, one end pivotally coupled to the fixed support relatively near a middle of the fixed support and the other end pivotally coupled to the movable frame member relatively near a top of the movable frame member, a lower pivot arm having two ends, one end pivotally coupled to the fixed support relatively near a bottom of the fixed support and the other end pivotally coupled to the movable frame member relatively near the middle of the movable frame member, said upper and lower pivot arms supporting the movable frame member and permitting the movable frame member to swing vertically downward from a first retracted position adjacent the fixed support to an extended position below the fixed support and to return to said retracted position, a retractable device, said device comprised of a cylinder mounted to a fixed support relatively near the top of the fixed support, and a flexible screen having two ends, one end attached to the cylinder and the opposite end attached to the movable frame member relatively near the top of the movable frame, said screen retracted around the cylinder when the movable frame member is in said retracted position, and said screen stretched between the fixed support and the movable frame member when the movable frame member is in said extended position.

* * * * *